US005832900A

United States Patent [19]

Lorraine

[11] Patent Number: 5,832,900

[45] Date of Patent: Nov. 10, 1998

[54] FUEL RECIRCULATION ARRANGEMENT AND METHOD FOR DIRECT FUEL INJECTION SYSTEM

[75] Inventor: Jack R. Lorraine, Newport News, Va.

[73] Assignee: Siemens Automotove Corporation, Auburn Hills, Mich.

[21] Appl. No.: 65,376

[22] Filed: Apr. 23, 1998

[51] Int. Cl.[6] ..... F02M 37/04

[52] U.S. Cl. ..... 123/456; 123/516; 123/514

[58] Field of Search ..... 123/456, 514, 123/458, 516

[56] References Cited

U.S. PATENT DOCUMENTS

| | | | |
|---|---|---|---|
| 5,186,138 | 2/1993 | Hashimoto | 123/456 |
| 5,237,978 | 8/1993 | Bailey | 123/456 |
| 5,327,872 | 7/1994 | Morikawa | 123/514 |
| 5,372,113 | 12/1994 | Smith | 123/456 |
| 5,425,342 | 6/1995 | Ariga | 123/456 |
| 5,458,103 | 10/1995 | Lauvin | 123/456 |
| 5,687,696 | 11/1997 | Takagi | 123/456 |
| 5,718,206 | 2/1998 | Sawada | 123/456 |
| 5,749,345 | 5/1998 | Treml | 123/456 |

FOREIGN PATENT DOCUMENTS

| | | | |
|---|---|---|---|
| 0124504 | 11/1984 | European Pat. Off. | 123/514 |

*Primary Examiner*—Carl S. Miller

[57] ABSTRACT

An arrangement and method for recirculating highly pressurized fuel from a fuel rail back to a high pressure pump inlet in which a fuel outflow is controllably allowed from the fuel rail into a nozzle to form a high pressure stream of fuel directed into a port connected to the inlet of the high pressure pump and a flow of fuel from a low pressure supply pump is merged into the stream by a surrounding annular flow pattern. This uses the energy of high pressure fuel to increase the pressure at the inlet of the high pressure pump and greatly reduces the tendency for the fuel vapor to form.

4 Claims, 1 Drawing Sheet

FUEL RECIRCULATION ARRANGEMENT AND METHOD FOR DIRECT FUEL INJECTION SYSTEM

BACKGROUND OF THE INVENTION

This invention concerns fuel injection systems for automotive gasoline engines. Gasoline engines have in recent years been equipped with fuel injection systems in which injector valves are installed protruding from pressurized fuel rails, with fuel sprayed out of the injector valves when each is opened at timed intervals by the engine controls. The injectors typically have been arranged to spray the fuel into the intake manifold adjacent the intake valves of the engine cylinders, such that the fuel in the fuel rail need only be pressurized to moderate levels, i.e., 3–4 bars in order to be sprayed into the intake manifold.

So-called "direct injection" systems for gasoline engines have been proposed, in which the injectors spray fuel directly into the engine cylinders. This requires a much higher fuel pressure, on the order of 20–140 bars at the injector tip, varying with fuel delivery requirements and engine cylinder pressures existing at the time of injection. The fuel pressure is developed by a high pressure pump. Fuel is supplied from the fuel tank to the inlet of the high pressure pump by a conventional lower pressure supply pump.

Variable fuel demand with engine output have been met by controlling the pressure in the fuel rail, achieved by a regulator allowing a controlled outflow of fuel from the fuel rail to a lower pressure region. The high operating pressures create the possibility that the fuel will be vaporized when discharged by the regulator. Lighter dissolved components, such as butane, methane, or even air, have a tendency to separate and form bubbles, which are very difficult to recombine with the liquid fuel. The presence of vapor or air bubbles in the liquid fuel recirculated back to the high pressure pump inlet could damage the high pressure pump.

The work performed by the high pressure pump in raising the fuel to these high pressures also adds to the internal heat of the fuel, increasing the tendency for vaporization and for the formation of bubbles to occur.

It is the object of the present invention to provide a fuel recirculation arrangement and method for minimizing the tendency for fuel vaporization in such high pressure direct injection systems.

SUMMARY OF THE INVENTION

The above object is achieved by providing the arrangement of a return flow path which directs the outflow of fuel from the regulator into a high pressure stream, and the supply flow from the low pressure pump surround the high pressure stream in such a manner that the fuel pressure of the high pressure pump inlet is increased.

This arrangement includes the formation of the high pressure stream of the fuel outflow from the regulator by directing the same through a nozzle, and the flow of low pressure fuel from the outlet of the low pressure pump is shaped into an annular flow pattern surrounding the high pressure stream. The high pressure stream increases the pressure of the surrounding incoming fuel flow from the fuel tank to raise the fuel pressure at the high pressure pump inlet by fluid shear effects. This arrangement reduces the energy required to pressurize the fuel by the high pressure pump, reducing the tendency for vaporization of the fuel.

At the same time, the high pressure return flow of fuel performs work on the incoming supply fuel flow, such that rather than the energy being utilized to supply the latent heat of vaporization of the fuel, further reducing the tendency for the fuel to partially vaporize.

This arrangement does not require any moving parts and thus is low cost and maintenance free.

DESCRIPTION OF THE DRAWING FIGURES

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
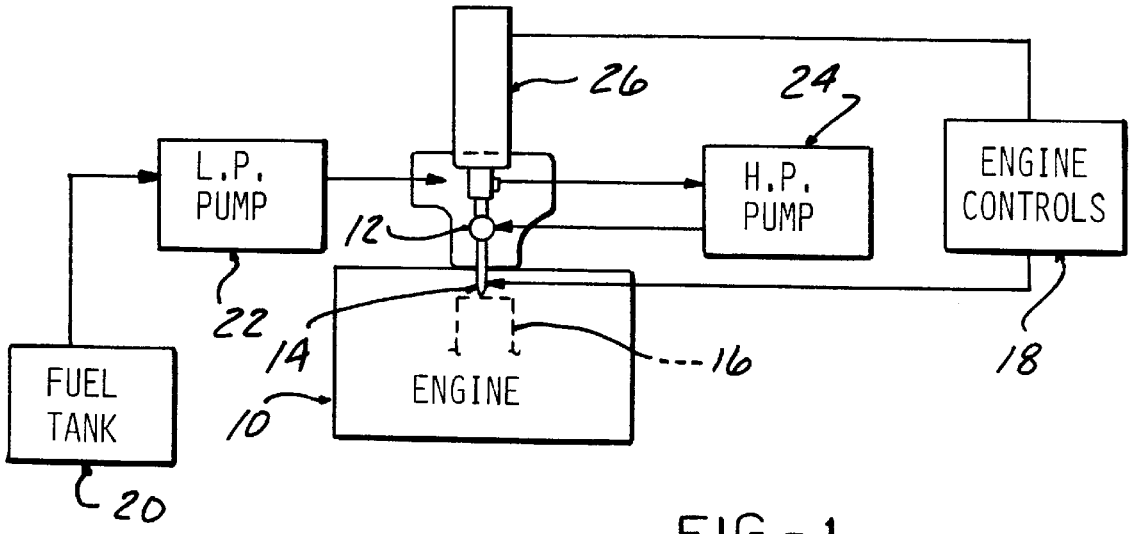
FIG. 1 is a diagrammatic representation of a fuel system incorporating the arrangement according to the present invention.

Referring to the drawings, FIG. 1 shows components of a fuel supply system for an automotive gasoline engine 10 of a type using a fuel rail 12, mounting a series of fuel injectors 14, which controllably direct a spray of fuel into a respective engine cylinder 16 when opened by the engine electronic controls 18. This arrangement comprises a "direct injection" form of electronic fuel injection.

Fuel is pumped from the fuel tank 20 by a conventional low pressure (3 bars) fuel pump 22, which may be mounted within the fuel tank 20 itself.

A high pressure pump 24 receives and further pressurizes the fuel prior to being supplied to the fuel rail 12, to the high levels required for direct injection, i.e., on the order of 140 bars.

Figure 2:
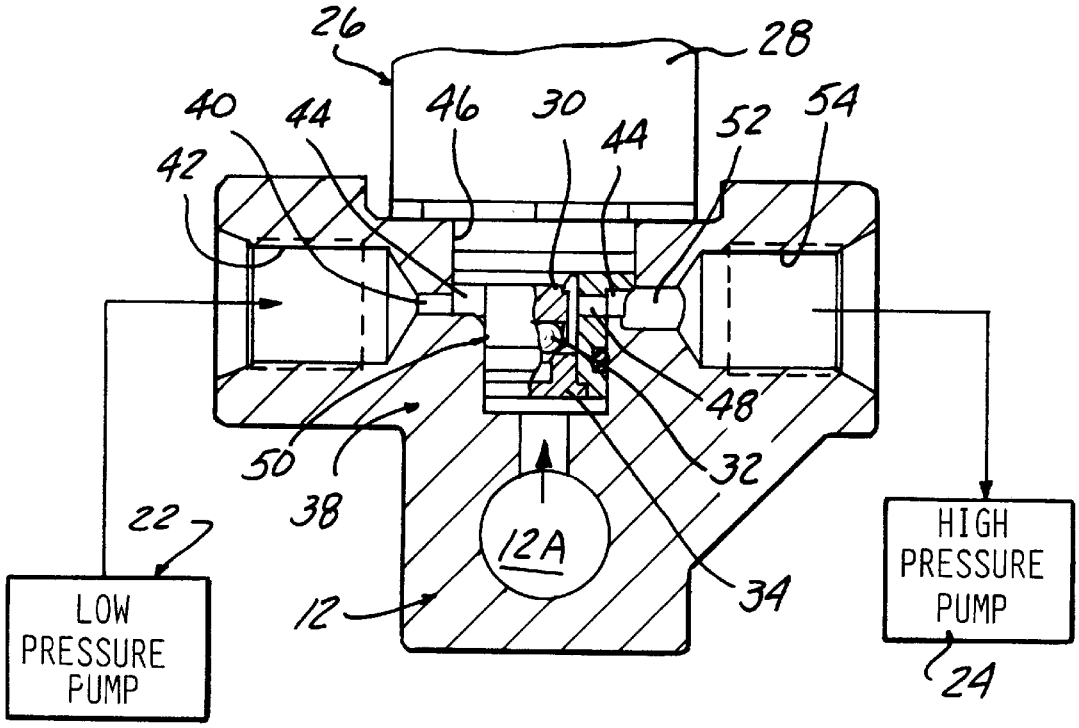
FIG. 2 is an enlarged sectional view of a fitting used to merge the supply and return flows, showing a fragmentary portion of the fuel rail pressure regulator and a diagrammatic representation of the low pressure pump and high pressure pump.

In order to vary the pressure in the fuel rail passage 12A, as required to be matched to the engine output demand, a pressure regulator 26 is opened and closed by the engine electronic controls 18 to controllably allow an outflow of fuel from the fuel rail passage 12A, to reduce the fuel rail pressure. Such pressure regulators are well-known and involve a solenoid coil 28, which, when energized, raises a rod 30 holding a ball valve 32 on a valve seat 34 to allow fuel outflow from the fuel rail passage 12A (FIG. 2).

According to the concept of the present invention, a fitting 38 (here shown integral with the fuel rail 12) is arranged to merge flow from the low pressure pump 22 and the outflow from the fuel rail passage 12A.

The outlet from the low pressure pump 22 is introduced into port 40 via a pipe fitting (not shown) received in threaded bore 42. Port 40 communicates with an annular space 44 surrounding the lower plug end 50 of the regulator 26 inserted into a stepped bore 46 in the fitting 38.

A high pressure stream of fuel is directed out of a nozzle 48, and into the orifice 44 on the opposite side of the regulator plug end 50 in the same direction as the surrounding annular supply flow stream.

The two flow streams merge, with the fluid shear forces causing an increase in the supply flow pressure by the much higher pressure return flow.

The fuel, now at an intermediate pressure (6–12 bars), passes out port 52, communicating with the inlet side of the high pressure pump 24 via a pipe fitting received in a threaded bore 54.

Thus, without using any moving parts, the arrangement and method according to the invention minimizes the tendency for vaporization of the fuel by utilizing the energy in the pressurized fuel to increase the pressure of the fuel supplied from the fuel tank. This in turn reduces the work required to be done by the high pressure pump 24 in pressurizing the fuel to the high levels needed for direct fuel injection. The work done by the high pressure outflow stream on the lower pressure supply flow makes less energy available to vaporize the lighter components in the fuel.

I claim:

1. In combination with an engine of the type including direct injection fuel injectors installed in a fuel rail a high pressure pump for pressurizing fuel directed into said fuel rail, fuel supplied to said high pressure pump by a low pressure supply pump connected to a fuel tank, the improvement comprising an arrangement for recirculating fuel from said fuel rail back to an inlet of said high pressure pump, said arrangement comprising:

a pressure regulator controllably allowing an outflow of fuel from said fuel rail;

a fitting receiving said outflow and including a nozzle directing said outflow of fuel into an outlet port of said fitting, said outlet port connected to said inlet of said high pressure pump;

said fitting also including an annular space surrounding said nozzle; and, a fluid connection between said low pressure supply pump to said annular space, whereby said outflow fuel flow from said nozzle merges with said flow from said supply pump and increases the pressure of said fuel at said high pressure pump inlet.

2. The combination according to claim 1 wherein said fitting is formed integrally with said fuel rail and has said pressure regulator received thereinto, said annular space defined around a portion of said pressure regulator.

3. A method of recirculating fuel from a highly pressurized fuel rail from a high pressure pump, said method comprising the steps of:

controllably allowing an outflow of pressurized fuel from said fuel rail so as to form a high pressure stream of fuel flowing into an inlet of said high pressure pump; and, directing a lower pressure supply of fuel flow adjacent to said high pressure stream of fuel, to merge the same together while increasing the pressure thereof by fluid shearing effect, whereby reducing the tendency for said recirculated fuel to vaporize.

4. The method according to claim 1 wherein said lower pressure supply fuel flow is directed in an annular flow pattern surrounding said high pressure stream of fuel.

* * * * *